US008113920B2

(12) United States Patent
Gissing

(10) Patent No.: US 8,113,920 B2
(45) Date of Patent: Feb. 14, 2012

(54) CUT-OFF WHEEL COMPRISING A DOUBLE CORE CLAMPING DEVICE

(76) Inventor: Gerhard Gissing, Allerheiligen (AT)

( * ) Notice: Subject to any disclaimer, the term of this patent is extended or adjusted under 35 U.S.C. 154(b) by 0 days.

(21) Appl. No.: 11/576,660

(22) PCT Filed: Oct. 18, 2005

(86) PCT No.: PCT/AT2005/000413

§ 371 (c)(1),
(2), (4) Date: Apr. 4, 2007

(87) PCT Pub. No.: WO2006/042352

PCT Pub. Date: Apr. 27, 2006

(65) Prior Publication Data

US 2007/0232212 A1 Oct. 4, 2007

(30) Foreign Application Priority Data

Oct. 19, 2004 (AT) ..... A 1749/2004

(51) Int. Cl.
*B24B 41/04* (2006.01)

(52) U.S. Cl. ..... 451/342; 451/544

(58) Field of Classification Search ..... 541/544, 541/546; 451/342, 343, 544, 546
See application file for complete search history.

(56) References Cited

U.S. PATENT DOCUMENTS 1,600,064 A * 9/1926 Perks ..... 451/342
2,004,630 A * 6/1935 Krug ..... 451/546
2,033,263 A * 3/1936 Tone ..... 51/293
2,259,554 A * 10/1941 Clark ..... 451/342
2,540,793 A * 2/1951 Metzger ..... 125/15
2,624,660 A * 1/1953 Ernest ..... 51/298
2,678,523 A * 5/1954 Leggett ..... 451/469
2,842,902 A * 7/1958 Miller et. al. ..... 451/469
2,894,583 A 7/1959 Johnstad
3,200,543 A * 8/1965 O'Neil, Jr. et al. ..... 451/469
3,307,242 A * 3/1967 Cofran ..... 83/841
3,566,547 A * 3/1971 Lonaberger et al. ..... 451/342
3,600,861 A * 8/1971 Haywood ..... 451/468
3,706,167 A * 12/1972 Schaffner ..... 451/466
3,850,589 A * 11/1974 Charvat ..... 51/296
3,898,773 A * 8/1975 Bogusch ..... 451/546
3,960,516 A * 6/1976 Biardi ..... 51/298

(Continued)

FOREIGN PATENT DOCUMENTS

AU 338 130 11/1976

(Continued)

OTHER PUBLICATIONS

CRG 100 of the Danish company AMC—SCHOU AS (www.ab-engine.ru, 2001).

(Continued)

*Primary Examiner* — Timothy V Eley
(74) *Attorney, Agent, or Firm* — Greenblum & Bernstein, P.L.C.

(57) ABSTRACT

The invention relates to a composite system for a cut-off wheel. The cut-off wheel includes an abrasive external cutting ring with depressions on both sides in the vicinity of the bore and two flush-fitting tensioning plates placed in the depressions to act as a core clamping device. The clamping plates are reusable elements, retained by the user, and transfer forces to the clamping flanges of the machine. The plates also increase stability and reduce waste.

31 Claims, 3 Drawing Sheets

U.S. PATENT DOCUMENTS

| | | | | |
|---|---|---|---|---|
| 4,069,622 | A * | 1/1978 | Swarovski | 451/543 |
| 4,258,509 | A * | 3/1981 | Wray et al. | 451/466 |
| 4,504,999 | A * | 3/1985 | Pedrotte | 15/230.1 |
| 4,576,057 | A * | 3/1986 | Saari | 74/424.92 |
| 4,907,376 | A * | 3/1990 | Bouchard et al. | 451/548 |
| 5,008,509 | A * | 4/1991 | Hattori et al. | 219/69.15 |
| 5,273,558 | A * | 12/1993 | Nelson et al. | 51/298 |
| 5,284,039 | A * | 2/1994 | Torgerson | 72/53 |
| 5,384,983 | A * | 1/1995 | Siggelin | 451/65 |
| 5,487,293 | A * | 1/1996 | Lovejoy | 72/53 |
| 5,539,172 | A * | 7/1996 | Takase et al. | 219/69.2 |
| 5,584,755 | A | 12/1996 | Alfer et al. | |
| 5,649,857 | A * | 7/1997 | Suhrheinrich et al. | 451/466 |
| 5,697,359 | A * | 12/1997 | Okanishi et al. | 125/15 |
| 5,758,531 | A * | 6/1998 | Graf | 72/53 |
| 5,851,142 | A * | 12/1998 | Bullock | 451/508 |
| 5,924,208 | A * | 7/1999 | Saeki | 30/388 |
| 6,116,996 | A * | 9/2000 | Yanase | 451/359 |
| 6,213,860 | B1 * | 4/2001 | Tunstall et al. | 451/541 |
| 6,332,836 | B1 * | 12/2001 | Tseng | 451/359 |
| 6,595,845 | B1 * | 7/2003 | Mizuno et al. | 451/548 |
| 6,749,496 | B2 * | 6/2004 | Mota et al. | 451/546 |
| 6,840,848 | B1 * | 1/2005 | Dyar | 451/344 |
| 6,840,850 | B2 * | 1/2005 | Bancon | 451/544 |
| 6,855,039 | B2 * | 2/2005 | Vidmore | 451/342 |
| 6,942,561 | B2 * | 9/2005 | Mota et al. | 451/541 |
| 7,115,029 | B2 * | 10/2006 | Lang et al. | 451/544 |
| 7,147,547 | B2 * | 12/2006 | Junker | 451/57 |
| 7,220,162 | B2 * | 5/2007 | Tanaka | 451/5 |
| 7,273,412 | B1 * | 9/2007 | Sun et al. | 451/508 |
| 7,465,222 | B1 * | 12/2008 | Sun et al. | 451/342 |
| 2005/0026557 | A1 * | 2/2005 | Chou | 451/541 |
| 2005/0107020 | A1 * | 5/2005 | Lang et al. | 451/544 |
| 2005/0260926 | A1 * | 11/2005 | Junker | 451/11 |

FOREIGN PATENT DOCUMENTS

| | | |
|---|---|---|
| CN | 2557288 Y | 6/2003 |
| EP | 0 769 352 | 4/1997 |
| EP | 0 832 720 | 4/1998 |
| EP | 1 332 834 | 8/2003 |
| GB | 2 003 503 | 3/1979 |
| JP | 64-46165 | 3/1989 |
| JP | 2003-260669 | 9/2003 |
| JP | 3096194 | 9/2003 |
| RU | 2157752 | 10/2000 |

OTHER PUBLICATIONS

Krainev A, "Machine Mechanics", Basic Glosary, Moscow, Machine Engineering, 2000, p. 800.

* cited by examiner

Fig. 2 SECTION A-A

CUT-OFF WHEEL COMPRISING A DOUBLE CORE CLAMPING DEVICE

CROSS-REFERENCE TO RELATED APPLICATIONS

The present application is a U.S. National Stage of International Patent Application No. PCT/AT2005/000413 filed Oct. 18, 2005, and claims priority under 35 U.S.C. §119 of Austrian Patent Application No. A 1749/2004 filed Oct. 19, 2004. Moreover, the disclosure of International Patent Application No. PCT/AT2005/000413 is expressly incorporated by reference herein in its entirety.

BACKGROUND OF THE INVENTION

1. Field of the Invention

The instant invention relates to the composite system for a synthetic resin-bonded cut-off wheel with an outer diameter of greater than or equal to 400 mm and, in particular, to a synthetic resin-bonded cut-off wheel having a cutting ring with depressions and two adapted edge-shaped clamping plates inserted into the depressions as reusable core clamping devices.

2. Discussion of Background Information

Synthetic resin-bonded cut-off wheels starting at a diameter of greater than or equal to 400 mm are used at stationary separating facilities in the metal-generating and metal-processing industry, to cut steel, cast iron, special alloys, inconell, titanium, etc.

The generally slight usability of conventional cutting wheels is a great disadvantage. In an ideal case, homogenous cut-off wheels can be used up to a minimum of 45% of the new diameter, but on average they can only be used up to 60% of the initial diameter, however, these figures depend on available machines as well as large material measurements.

Once used, the remaining residual discs must be disposed of at high costs according to national disposal guidelines. Another disadvantage is the use of raw material for the unused core zones in the cut-off wheel, which results in additional costs for the raw material sector despite the availability of alternative abrasive grain materials for reinforcement and resin portions of a cut-off wheel.

European Patent 0 832 720 A2 describes a synthetic resin-bonded fabric-reinforced cut-off wheel by means of a non-positive bonding on a metallic base body. This system, however, was not able to establish itself because a small residual film of the grind-active edge zone remains on the base of the body. Therefore, the need to dispose of a metal core comprising a synthetic resin-bonded residual film still remains.

A further solution is described in EP 0 769 352 A1, wherein the grind-active edge zone is pressed on a metallic base body in a non-positive manner during production. The high-priced acquisition of a large number of these base bodies has turned out to be a disadvantage. In addition, there is a logistical problem when returning the used composite cutting wheel, which must be sent back to the manufacturer to be re-plated. Thus, for cost reasons, this system can only be used at a limited distance to the manufacturer. In addition, the cleaning and re-plating associated with the cut-off wheel requires a greater technical effort, time, and cost.

BRIEF SUMMARY OF THE INVENTION

An aspect of the instant invention is to create a composite system, which eliminates the above-mentioned disadvantages and makes it possible for the user to deplete the external cut-off wheel up to 95% of the entire grind-active cutting ring surface, and further ensures additional advantages such as a reduced cutting wheel width and increasing stability.

According to the invention, this aspect is achieved by synchronizing the bore diameter of the cut-off wheel to the minimum depletion diameter and pressing the edge form of the two clamping plates, which are offset on both sides, into the depressions. This enables a virtually complete depletion of the grind-active edge zone, and only a small abrasive residual ring must be disposed of.

The two clamping plates, which are to be considered to be connecting elements between the actual clamping flanges at the machine side and the grind-active cutting ring, are essential components of this invention. Because the transition from the clamping flange to the cutting wheel for conventional products represents a weak spot, this disadvantage is considerably improved according to the invention by the material of the clamping plates, which is possible as an alternative.

Due to the fact that the two clamping plates remain with the user, only the considerably lighter cutting ring must be sent to the customer and a weight savings of up to 40% is thereby possible.

BRIEF DESCRIPTION OF THE DRAWINGS

Additional features and details of the instant invention can be found in the description of the figures below. It is shown therein.

DETAILED DESCRIPTION OF THE INVENTION

The cut-off wheel 10 illustrated in the figures is a synthetic resin-bonded cut-off wheel 10, preferably without additional material reinforcement. However, different degrees of hardness are adapted to respective application requirements and customer requests via a systematic selection of phenolic resin in combination with coordinated abrasive grains and fillers.

Corundum, specifically special corundum, zircon corundum, and sinter corundum as well as silicon carbide are used as grinding mechanisms. The fillers comprise raw materials, such as pyrite, zinc sulphide, graphite, potassium chlorine manganate, etc., which are also presently used in cutting wheels for industrial applications.

Glass material inserts are presently used as material reinforcement 5. In the future, however, alternatives such as Kevlar® or carbon fiber are possible. Additionally, an embodiment without a continuous reinforcement is possible. However, reinforcements should be provided in the region of the depressions.

The outer diameter D of the cut-off wheel 10 typically lies between 400 and 2000 mm, however, preferably the outer diameter D is greater than 800 mm. Ideally, the bore diameter d of the cut-off wheel 10 can be adjusted to an applied minimum diameter. For manufacturing reasons, however, a fixed bore diameter d should be chosen based on the respective standard measurement of the cutting ring 1. A range of 40-80% of the outer diameter D is to be indicated as the recommended value for the bore diameter d.

Presently, the ratio of the outer diameter D to the width T typically lies in the range of 80-100. According to the invention, due to the considerably stiffer core zone, an increase of up to 130 can be realized. The grind-active cutting ring 1 can be embodied on a parallel plane, as well as in a conical manner, i.e., so as to taper towards the bore region.

Figure 1:
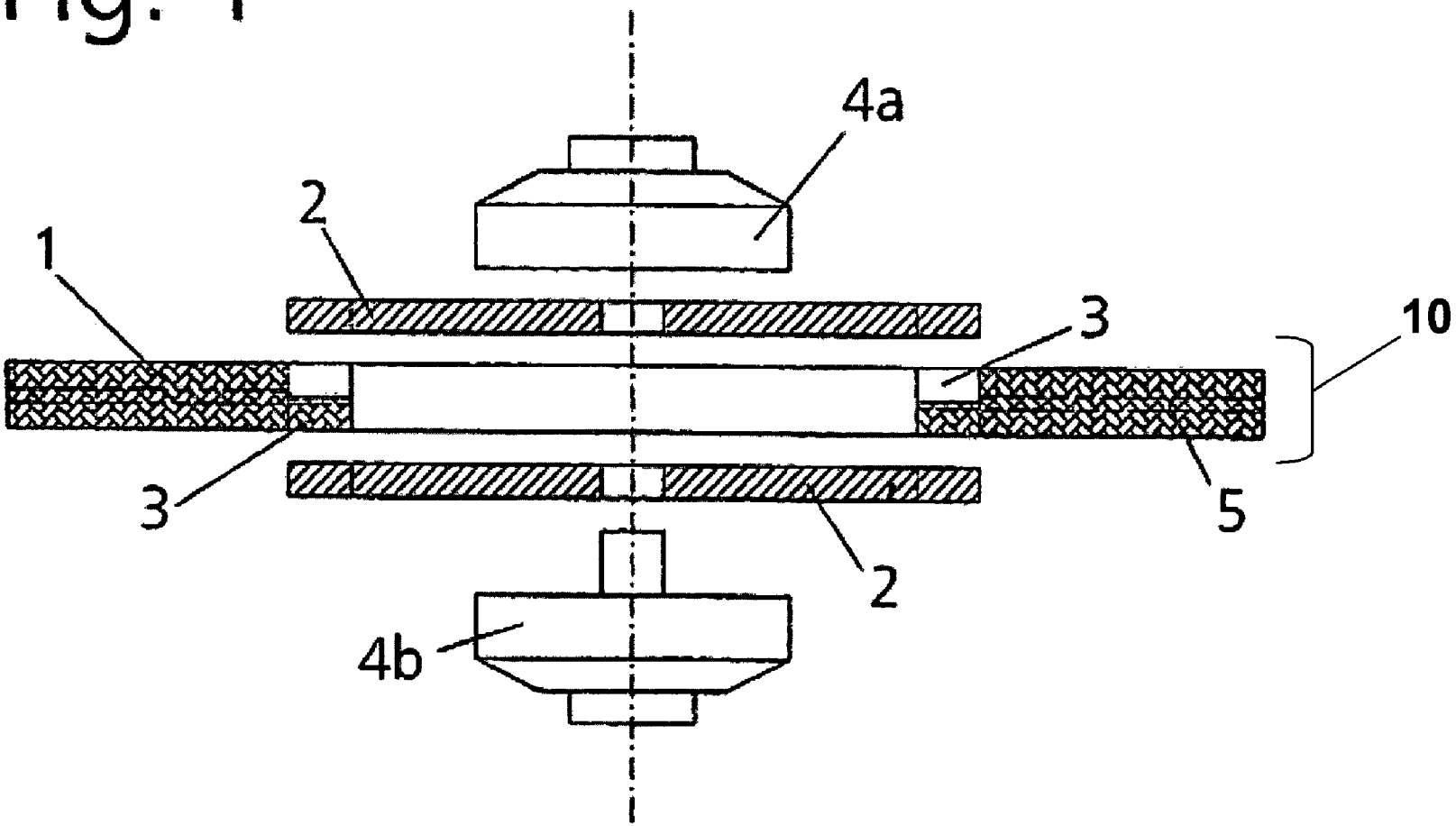
FIG. 1 is an exploded illustration of a cut-off wheel with double clamping plates in accordance with the invention.
Figure 2:
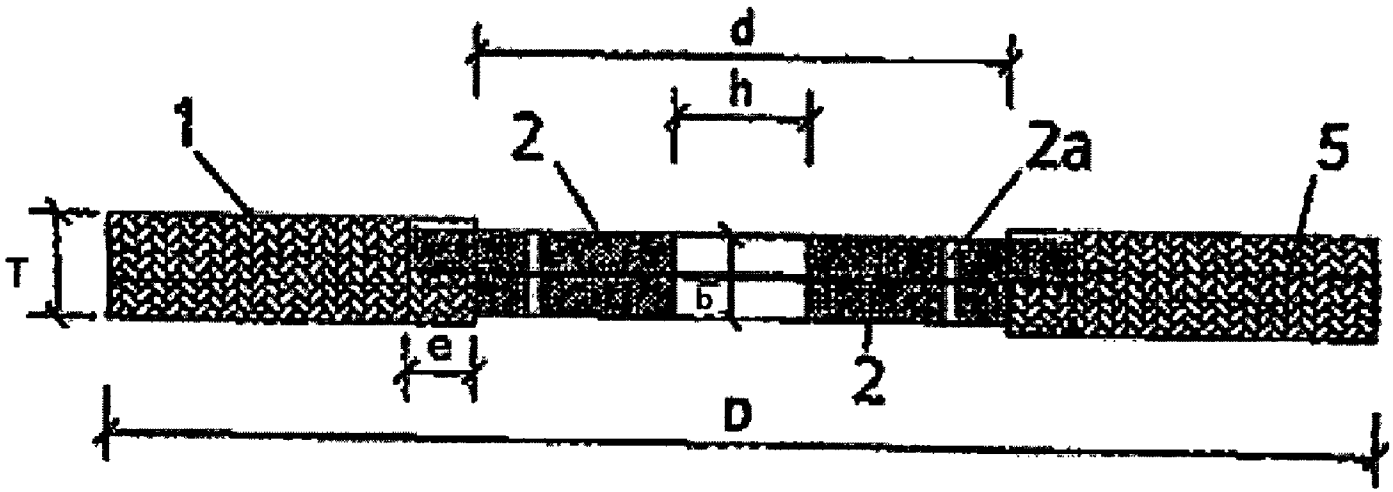
FIG. 2 is a sectional view through the composite system along the line A-A in FIG. 3.
Figure 3:
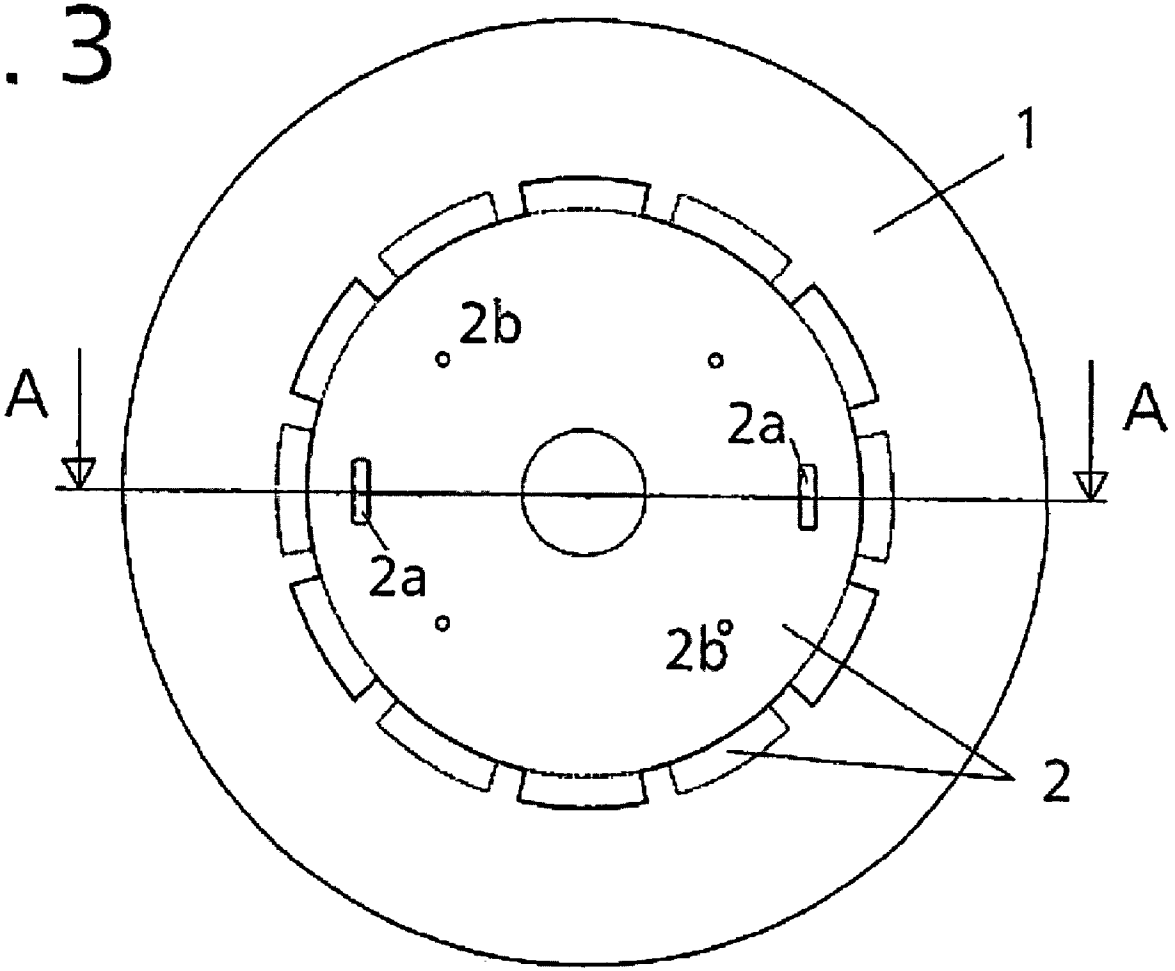
FIG. 3 is a side view of the cutting ring composite system.

For clarity reasons, the width T in FIGS. 1 and 2 is illustrated many times too large in relation to the outer diameter D.

On both sides of the flat surface in the bore region, the cut-off wheel 10 encompasses a plurality of geometric depressions (or recesses) 3, into which the two clamping plates 2 are inserted with an exact fit. The shape of these depressions 3 can be embodied so as to be round, rectangular, but preferably like a dovetail. To enable a good pretensioning of the clamping plates 2, the depth of these depressions 3 must be between 0.1 and 1 mm, and preferably 0.2 to 0.6 mm less than half of the cutting ring width T in the bore region. The radial reach e of these depressions 3 is a function of the outer diameter D and is between 10 and 200 mm, and preferably between 30 and 60 mm.

The two clamping plates 2, having a defined edge shape, fit exactly into the bilateral depressions 3 of the cut-off wheel 10, and are a considerable component of this system. In response to being clamped with the conventional clamping flanges 4*a* and 4*b*, the two clamping plates 2 are compressed and the required lateral clamping force is thus generated. The drive shaft thereby transfers the forces required for the clamping process to the two clamping plates 2 via the clamping flanges 4*a* and 4*b*. From there, the forces are finally transmitted via the special edge shape to the grind-active abrasive cutting ring 1 in a non-positive manner.

The clamping plates 2 can be embodied in a straight, offset, perforated or also in a corrugated shape. As a possibility for reducing the weight, the clamping plates 2 can be provided with additional depressions 3.

The depressions 3 of the two clamping plates 2 is characterized by a plurality of symmetrically, round, square, dovetail-shaped, or similarly formed protruding clamping surfaces, which must fit exactly into the bilaterally pressed depressions 3 of the grind-active cutting ring 1, and which can thus transfer the forces which occur during the abrasive cutting.

The total thickness of the two clamping plates 2 must be slight, i.e. approximately 5-10% thinner than the wheel width T in the bore region of the cut-off wheel 10. In doing so, it is ensured that the required free cutting depth is achieved as with conventional cutting wheels.

High-strength reinforced synthetic materials, carbon fibers, non-ferrous metals, special alloys, titanium, but preferably presently simple steel plates are used as material for the clamping plates 2. In addition to the required basic strength, it is an important criterion for the material to encompass a certain flexibility and high residual stress, so as to be able to withstand the lateral force effects occurring in response to such applications, without permanent damage.

To facilitate the handling in response to clamping the composite system, provisions are made in the clamping plates 2 for slits 2*a*, into which special tension springs are inserted to aid in clamping. When dealing with very large clamping plates 2 (greater than 60% of the outer diameter of the cutting ring 1), additional bores 2*b* can be installed in the outer diameter region of the clamping plates 2 as an additional fixing, or to increase clamping force. Thereby, connecting elements do not protrude beyond the end face of the clamping plate 2.

The position and form-exact pressing of the cut-off wheel 10 into the depressions 3 in the bore region is required. This is achieved by pressing a template having an exact fit. In the alternative, the depressions 3 can also be subsequently ground at a suitable processing facility.

The invention claimed is:

1. An apparatus comprising:

at least one grind-active cutting ring having a first and second surface and at least one bore through the at least one grind-active cutting ring and a plurality of depressions located in both the first and second surface of the at least one grind-active cutting ring adjacent the bore; and at least two clamping plates having outer peripheral edges and being structured to clamp the at least one grind-active cutting ring, wherein at least portions of the outer peripheral edges of the at least two clamping plates are positionable within the at least one bore to engage an inside edge of the at least one bore and at least other portions of the outer peripheral edges of the at least two clamping plates are positionable within the depressions, whereby the at least two clamping plates are structured to fit the at least one grind-active cutting ring in a clamping force fit connection.

2. The apparatus of claim 1, wherein the at least one grind-active cutting ring forms a cut-off wheel.

3. The apparatus of claim 2, wherein the cut-off wheel has a diameter greater than or equal to 400 mm.

4. The apparatus of claim 2, wherein the cut-off wheel comprises a mixture of abrasive grit, binder, and filler.

5. The apparatus of claim 2, wherein the grind-active cutting ring is structured to taper towards the bore up to 3 mm relative to a plane parallel to and through a center of the grind-active ring.

6. The apparatus of claim 5, wherein the grind-active cutting ring comprises a conical shape.

7. The apparatus of claim 2, wherein a ratio of a diameter of the cut-off wheel to a width of the cut-off wheel is above 70.

8. The apparatus of claim 7, wherein the ratio is above 90.

9. The apparatus of claim 2, wherein the bore is greater than 40% of an outer diameter of the cut-off wheel.

10. The apparatus of claim 2, wherein the cut-off wheel includes at least one material insert.

11. The apparatus of claim 2, wherein the cut-off wheel preferably includes two or more material inserts.

12. The apparatus of claim 1, wherein some of the plurality of depressions are located in the first surface adjacent the bore and others of the plurality of depressions are located in the second surface adjacent the bore, and wherein the plurality of depression extend into but not through the at least one grind-active cutting ring.

13. The apparatus of claim 12, wherein the at least two clamping plates have an edge shape structured and arranged to fit the depressions of the cutting ring.

14. The apparatus of claim 12, wherein the depressions on one-side of the at least one grind-active cutting ring are displaced relative to the depressions on the other side of the at least one grind-active cutting ring.

15. The apparatus of claim 12, wherein the depressions are adjacent to the bore.

16. The apparatus of claim 12, wherein the depressions are round, square, or dovetail-shaped.

17. The apparatus of claim 1, wherein the grind-active cutting ring comprises a synthetic resin-bonded material.

18. The apparatus of claim 1, wherein the at least two clamping plates are embodied in an offset, perforated, or straight form.

19. The apparatus of claim 1, wherein the at least two clamping plates comprise one or more of carbon fibers, high-strength reinforced synthetic materials, non-ferrous metals, special alloys, titanium, and sheet metal.

20. The apparatus of claim 1, wherein the at least two clamping plates comprise sheet metal.

21. The apparatus of claim 1, wherein a total width of the at least two clamping plates is between 1% and 20% thinner than a width of the cutting ring in the bore.

22. The apparatus of claim 21, wherein the total width of the at least two clamping plates is between 5% and 10% thinner than the width of the cutting ring in the bore.

23. The apparatus of claim 1, further comprising an insulation film at least one of inserted and glued between the at least two clamping plates.

24. The apparatus of claim 1, further comprising at least one of slits and additional bores installed in the at least two clamping plates, thereby acting as a clamping aid or an additional clamping force reinforcement.

25. The apparatus of claim 24, wherein at least one tension spring is inserted into the slits.

26. The apparatus of claim 1, wherein the at least one bore is cylindrical.

27. The apparatus of claim 26, wherein the at least one bore has a constant diameter.

28. The apparatus of claim 1, wherein the at least one grind-active cutting ring extends radially inwardly only to the outer peripheral edges of the clamping plates.

29. The apparatus of claim 1, wherein the depressions are arranged to open into the at least one bore.

30. A method for making the apparatus of claim 1, comprising: one of:

pressing depressions into the at least one grind-active cutting ring using a template, or grounding depressions into the at least one grind-active cutting ring.

31. The method of claim 30, further comprising positioning at least two clamping plates into the depressions with a force fit connection.

* * * * *